US005477793A

United States Patent [19]

Selm et al.

[11] Patent Number: 5,477,793

[45] Date of Patent: Dec. 26, 1995

[54] CUTTING AND NIPPING APPARATUS FOR THE FRONT YARN FOR EMBROIDERY MACHINES

[75] Inventors: Livio Selm, Berg; Max Schreiber, Arbon; Jürg Henz, Amriswil, all of Switzerland

[73] Assignee: Sauer Sticksysteme AG, Arbon, Switzerland

[21] Appl. No.: 181,670

[22] Filed: Jan. 14, 1994

[30] Foreign Application Priority Data

Jan. 15, 1993 [DE] Germany ..... 43 00 846.1

[51] Int. Cl.[6] ..... D05C 11/20

[52] U.S. Cl. ..... 112/83; 112/295

[58] Field of Search ..... 112/80.55, 80.56, 112/80.59, 80.60, 80.7, 80.71, 285, 292, 93, 97, 95, 78, 83, 253, 295

[56] References Cited

U.S. PATENT DOCUMENTS

| | | | |
|---|---|---|---|
| 1,080,915 | 12/1913 | Keller | 112/83 |
| 1,107,711 | 8/1914 | Schoenfeld | 112/83 |
| 1,203,447 | 10/1916 | Zenorini | 112/93 |
| 1,211,933 | 1/1917 | Granz | 112/93 |
| 1,266,083 | 5/1918 | Tittes et al. | 112/97 |
| 3,349,733 | 10/1967 | Ree | 112/83 |
| 3,532,065 | 10/1970 | Marforio | 112/292 |
| 5,125,351 | 6/1992 | Prais et al. | 112/292 |
| 5,140,130 | 10/1992 | Gribetz et al. | 112/292 |

FOREIGN PATENT DOCUMENTS

| | | |
|---|---|---|
| 0468892 | 1/1992 | European Pat. Off. . |
| 267243 | 2/1912 | Germany . |
| 3133333 | 3/1983 | Germany . |
| 3502886 | 7/1986 | Germany . |
| 4202891 | 5/1993 | Germany . |
| 536893 | 6/1973 | Switzerland . |
| 577587 | 7/1976 | Switzerland . |
| 647283 | 1/1985 | Switzerland . |

*Primary Examiner*—C. D. Crowder
*Assistant Examiner*—Ismael Izaguirre
*Attorney, Agent, or Firm*—Baker, Maxham, Jester & Meador

[57] ABSTRACT

A cutting apparatus for embroidery machines that facilitates the positive cutting of the threads at the end of each embroidery operation. Large-scale embroidery machines may provide several hundred embroidery positions, and each position is provided with an individually-actuable cutting and gripping device. These individual cutting mechanisms are in turn collectively mounted on one or more feeder bars that permit the pivotal movement of the cutter/grippers into and away from a position in close proximity to the embroidery needle stitch points. This pivotal movement permits the close cutting of the thread when required, yet otherwise locates the thread cutter/grippers at a position away from the stitch points during the embroidery operation itself.

16 Claims, 7 Drawing Sheets

20
16
3
15
1
31
12
44
29
10
27
28
13
14
7
30
25
26
8
9
2
23
24
39
38

CUTTING AND NIPPING APPARATUS FOR THE FRONT YARN FOR EMBROIDERY MACHINES

BACKGROUND OF THE INVENTION

1. Field of the Invention

This invention relates generally to large-scale embroidery machines, and more particularly to cutting and gripping apparatus that facilitates positive cutting of all threads so that the embroidery operation can be quickly resumed.

2. Description of the Related Art

On large-scale embroidery machines with several hundred embroidery positions, it is difficult to cut and secure the embroidery yarn by hand, which thus causes prolonged down times. Furthermore, the embroidery yarn on the front side should be cut cleanly and as close to the bottom of the embroidery as possible in order to save on the additional cutting process. Such a cutting and nipping device also offers great advantages in programming and embroidering colored patterns or repeat patterns. Cutting and nipping devices developed for sewing machines or multi-head embroidery machines cannot be adapted. They are too large for the standard needle spacing of 27.01 mm (1 French inch) and they are too complicated and expensive for use on hundreds of embroidery positions. Examples of relevant but different structures are discussed below.

Swiss patent 577,587 (Pfaff) discloses such a device consisting of multi-head embroidery machines for nipping and cutting the needle thread. With 500 to 1000 embroidery positions on a large-scale embroidery machine with a spacing of 27.01 mm, such a device is hardly feasible from the standpoint of either size or cost.

Swiss patent 536,893 (Metalmeccanica) describes a cutting device for the front threads on a large-scale embroidery machine. A blade is mounted on a carriage which is moved over the entire length of the machine in parallel with the plane of the fabric, so the front threads are cut one after the other. A clean cut can be achieved only if the front threads are stretched taut. Hundreds of threads must be cut by the same blade with each cutting operation, which thus cause the blade to quickly become dull. When performing a cut with this device, there is a side force acting on the thread at the moment of cutting, which can lead to a defect in the resulting knit due to the pulling effect. Gripping or nipping of the thread is impossible with this type of device. A cutting device that does not include a means of gripping the thread cannot be used with an embroidery machine because most of the threads would slip out of the needles in a short period of time.

Swiss patent 647,283 (Heinzle) discloses a simple cutting and gripping device that can be attached to the pressure foot provided with each needle. Reliable cutting of the threads cannot be expected due to the relatively slow lateral movement of the embroidery frame. Eventually, loosening or destruction of the cutting and gripping elements can be expected due to the repeated impacts of the pressure foot against the fabric during the embroidery operation.

German patent 3,502,886 (Reich) discloses cutting elements mounted on a shaft. The cutting elements are pressed against the fabric and thus advanced on the fabric by the revolutions of this shaft. In this forward movement, the threads are to be cut by a single blade. No device is provided for gripping the thread.

SUMMARY OF THE INVENTION

The present invention presents a cutting and gripping apparatus for large-scale embroidery machines that can be implemented in an inexpensive and space-saving design and solves the entire problem of gripping, cutting and resuming the embroidery operation. Due to the arrangement of two opposing blades that are actively operated, reliable cutting of all threads is made possible.

The essential feature of the present invention is that the cutting and gripping elements are present in large numbers on a large-scale embroidery machine and each embroidery position has its own cutting and gripping device. This yields the advantage of individual control of the cutting and gripping elements because in another embodiment of this invention, the cutting and gripping elements can be controlled separately.

An important feature of this invention is that each thread to be cut is first gripped before cutting and then is cut off. This yields the advantage that the thread is cut only after it has been gripped and thus is being held securely. This is associated with the additional advantage that the thread is brought to a resting position after being gripped, which thus prevents the thread from becoming unthreaded from the needle and furthermore, the cutting and gripping device according to this invention is brought to a position spaced from the plane of the fabric, i.e., at some distance from the plane of the fabric, so this is in turn associated with the advantage that it no longer rubs along the fabric and thus might lead to damage.

In another embodiment of this invention, the cutting and gripping apparatus operates with a movable blade and with a stationary blade. This yields the advantage that the resulting cutting effect is similar to that achieved with scissors—in other words, this yields accurate cutting and there is no pull on the thread, so the fabric cannot undergo deformation in an unwanted manner.

Due to the advantage that the cutting and gripping device is located a short distance (for example, 1 mm) in front of the plane of the fabric during the cutting operation, this yields the advantage of a short end of the thread and therefore the cut-off ends of the threads need not be processed later in another operation.

Since all the gripping elements are attached to one bar, all the gripping elements can be actuated with a single rapier under some circumstances. This yields the further advantage of low machine costs and low manufacturing and maintenance costs accordingly.

The main feature of this invention is thus that the actively operated cutting and gripping elements can be brought together with their feeder bar, can be brought from a resting position at some distance away from the plane of the fabric into an active position close to the embroidery fabric and then back into their resting position. This yields the above-mentioned advantage that the cutting and gripping devices are some distance away from the fabric in the resting position and cannot collide with it, whereas the cutting and gripping elements are practically in contact with the fabric in the cutting position and thus leave extremely short thread ends on the fabric.

The above-mentioned feeder bar executes a movement that follows the shape of a parallelogram in one plane as a pivoting movement at right angles to the web of the fabric.

The advantage of this parallelogram movement is that the needles move from the resting position toward the fabric, while at the same time there is a lateral approaching movement toward the point where the embroidery needle punctures the fabric.

BRIEF DESCRIPTION OF THE DRAWING

The objects, advantages and features of the invention will be more readily perceived from the following detailed description, when read in conjunction with the accompanying drawing, in which.

DESCRIPTION OF THE PREFERRED EMBODIMENTS

Figure 1A:
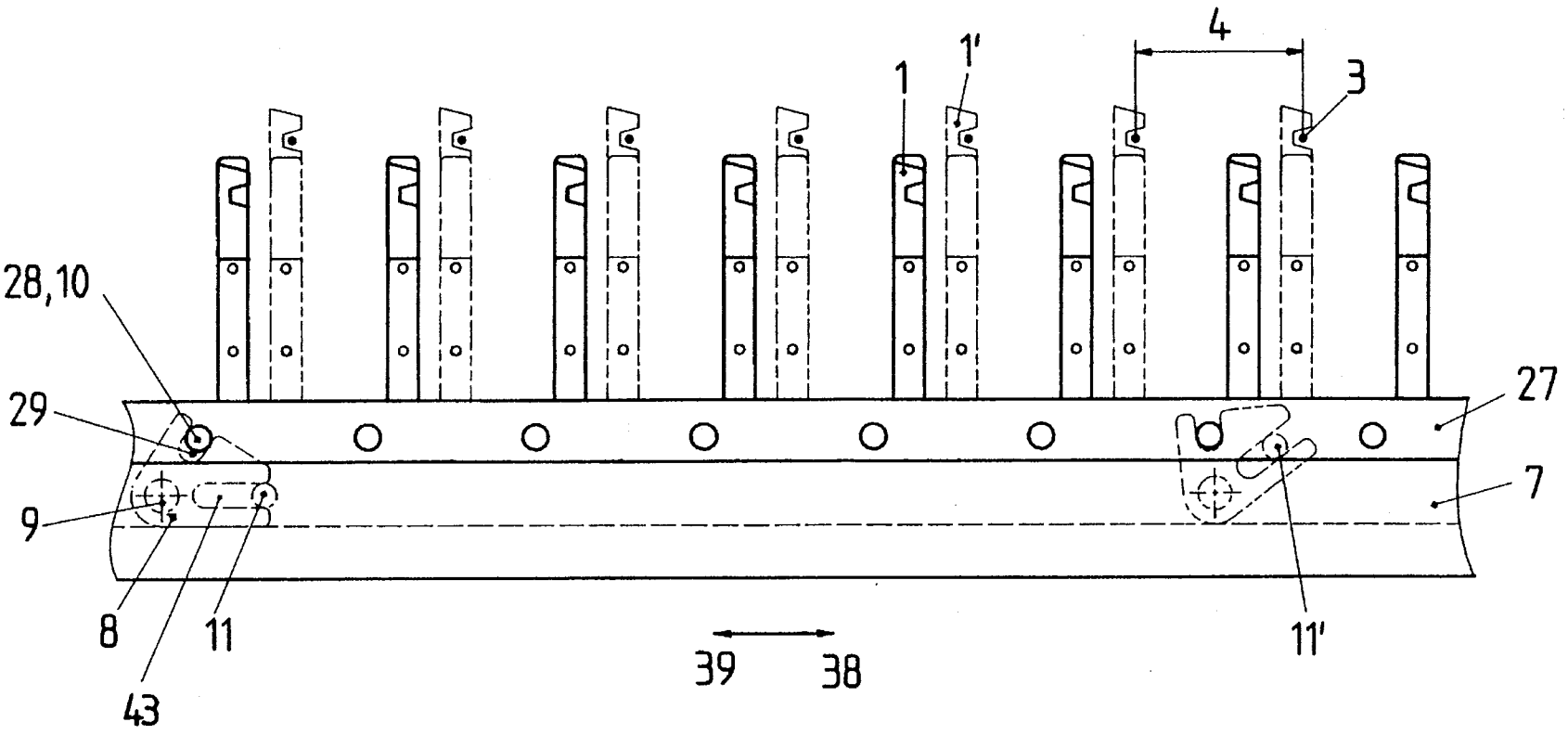
FIGS. 1*a* and 1*b* are front and top views, respectively, of a section of a feeder bar with cutting and gripping elements of the invention in the "forward" and "rearward" positions.
Figure 1B:
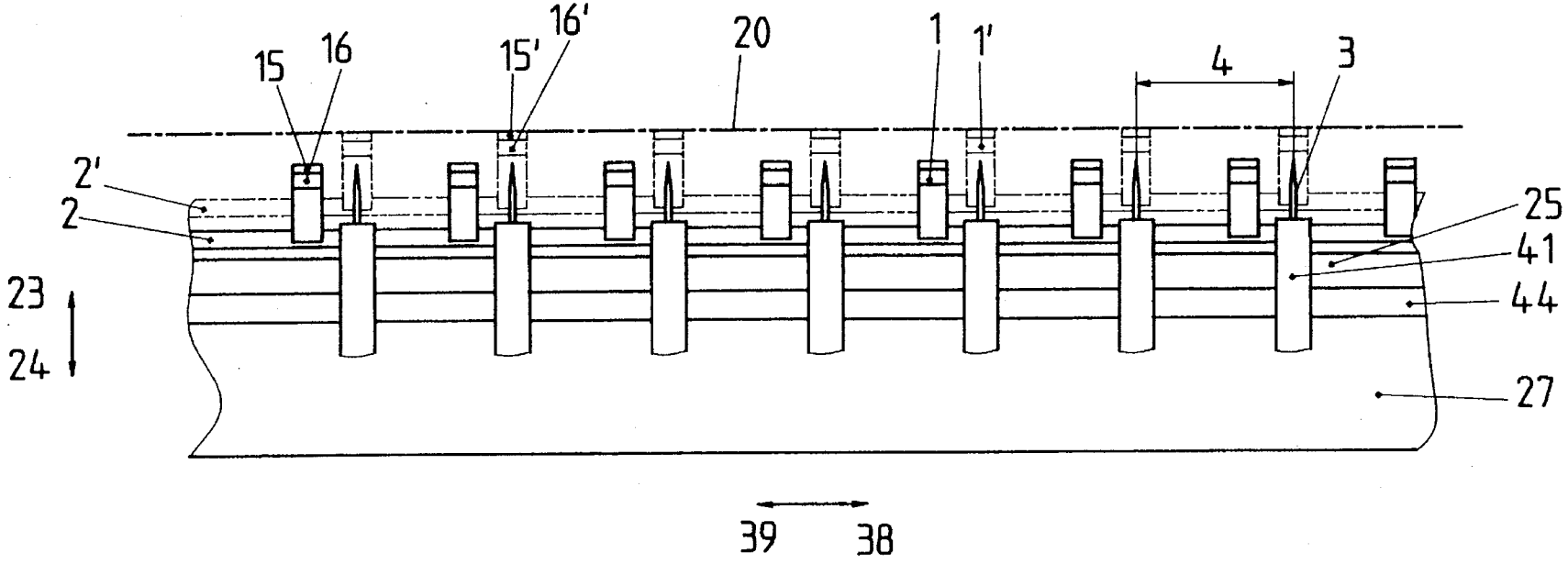

FIG. 1*b* shows a section through a feeder bar 2 which extends over an embroidery length of several hundred embroidery needles on large-scale embroidery machines. These embroidery needles 3 are arranged in a line with a needle spacing 4 of one French inch (27.01 mm). Cutting and gripping elements are mounted on the feeder bar 2, so that each embroidery needle 3 or each embroidery position has its own cutting and gripping elements. During the embroidery operation, the embroidery tools (embroidery needles 3, drill) must be able to operate freely and without being hindered. Therefore, the feeder bar 2 is shown in the "rear" position (pulled out completely in FIG. 1*b*).

Figure 3B:
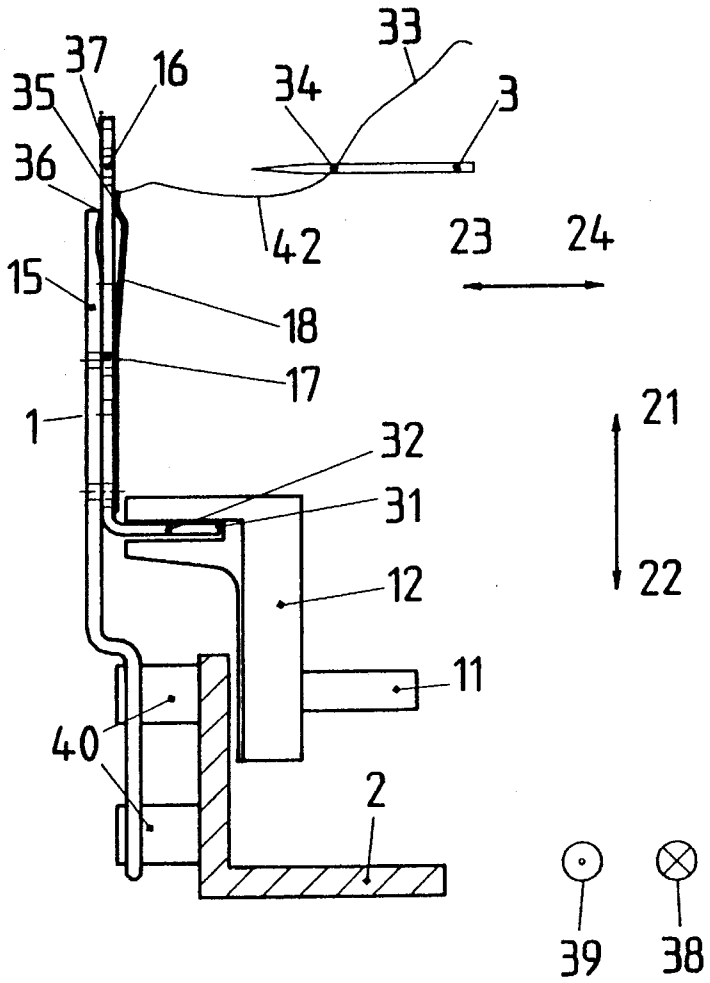
FIGS. 3*a* and 3*b* are front and side views of the cutting and gripping device of the invention.
Figure 3A:
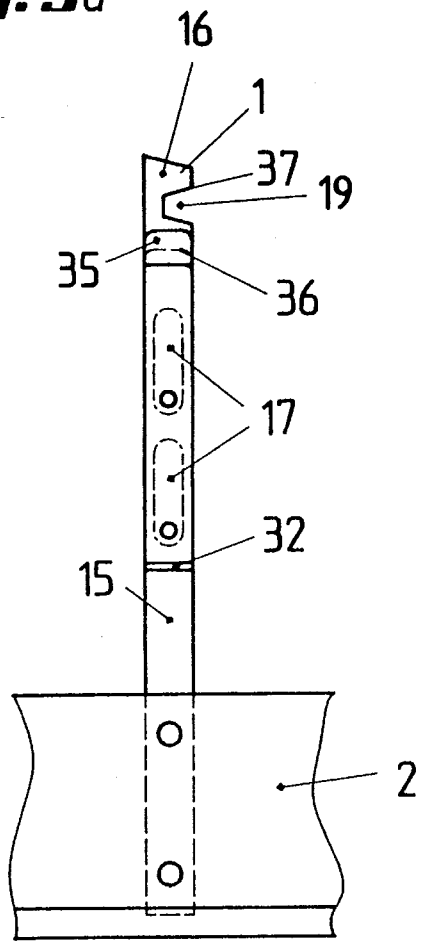

With reference to FIGS. 3*a* and 3*b*, the cutting and gripping element consists essentially of a stationary blade 15 that is mounted with pins 40 on the vertical leg of feeder bar 2. A movable blade 16 is guided so it can slide lengthwise in the direction of arrows 21 and 22 on the stationary blade 15 by means of a parallel guide 17 consisting of hollow rivets and elongated recesses accordingly. Friction spring 18 is attached to the stationary blade 15 and forms a friction gap with respect to the movable blade 16, where said friction gap is defined by the end 35 of the spring on the one hand and by a corresponding front side of the movable blade on the other hand.

Friction spring 18 also has the function of preventing any inadmissible play between the stationary blade 15 and the movable blade 16 by pressing the movable blade against the stationary blade and thus the scissors-like cutting action is always maintained, regardless of any wear on blades 15 and 16.

According to FIG. 3*b*, the thread 33 to be cut is guided through the needle eye 34 of the embroidery needle 3 and is gripped and secured in the form of thread end 42 in the gripping position (spring end 35).

Figure 1C:
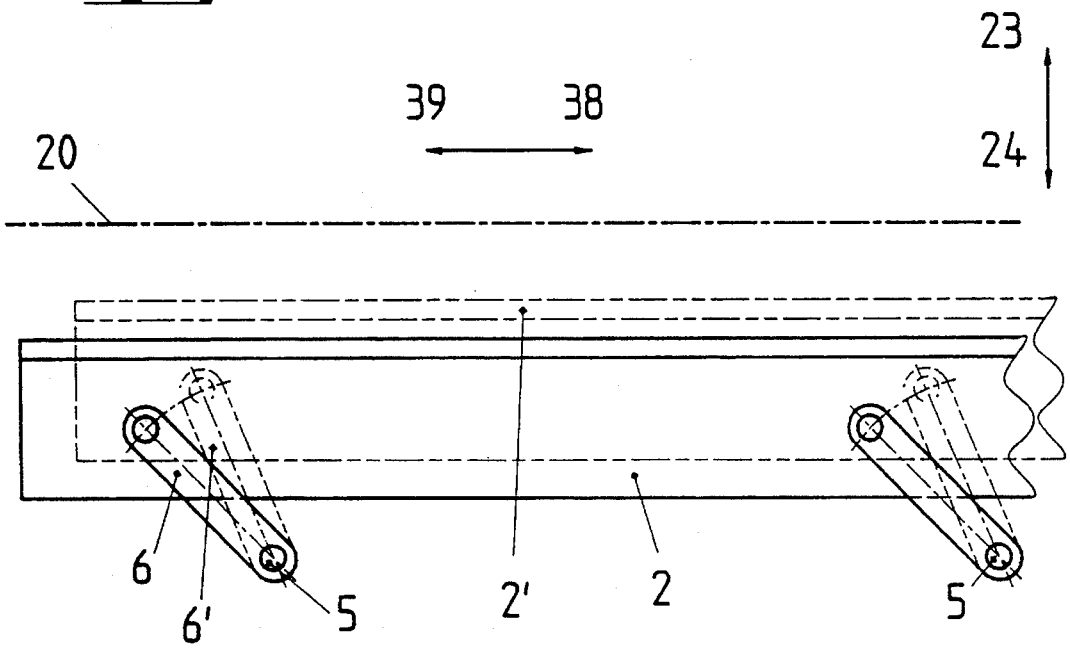
FIG. 1*c* schematically shows the movement of the feeder bar of FIG. 1.
Figure 1D:
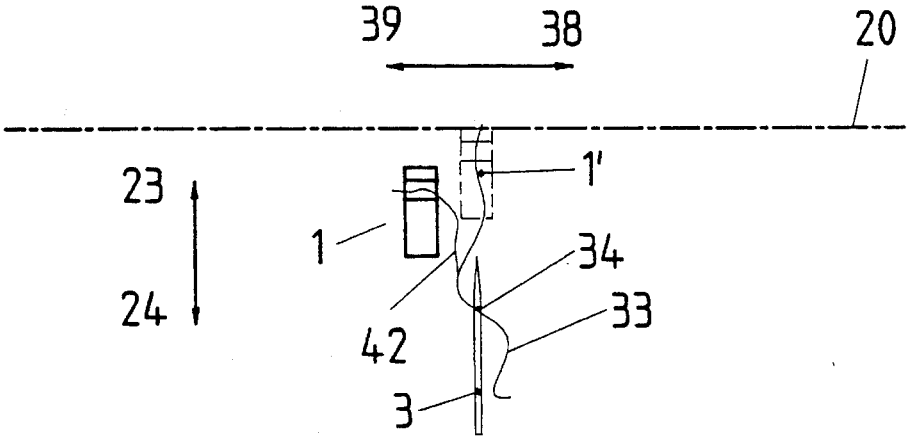
FIG. 1*d* shows the movement of the cutting and gripping elements of FIG. 1.

FIG. 3*b* shows the actual position of the movable blade 16 in a raised position (direction of arrow 21) when the entire cutting and gripping element 1 is advanced out of a resting position according to FIG. 1*d* (left) into the cutting position (FIG. 1*d*-right), and in doing so, with the movable blade 16 raised, the side recess 19 in the movable blade is moved over the thread 33 that is to be cut and the thread end is gripped in the recess 19.

Only then does the movable blade 16 move downward in the direction of arrow 22, thereby gripping the thread in spring end 35 and then cutting it in the same movement. It is important here that as the movable blade 16 moves down, first the thread that is to be cut off enters the area of spring end 35 and is secured thereto whereby the edges on the side of the movable blade facing spring end 35 are polished so they will cut the thread cleanly—in other words, they are rounded off so that no cutting can take place in this area. For this reason, the thread 33 is secured on spring end 35 on this side (at the right in FIG. 3*b*), whereas on the opposite side (on the left in FIG. 3*b*) there is the blade edge 37 of the movable blade which together with the respective blade edge 36 of the stationary blade 15 executes the cutting operation.

The movement of the movable blade 16 in the directions of arrows 21 and 22 takes place through the action of a sliding piece 12 which engages with a groove 31 facing in the longitudinal direction of feeder bar 2 over a bent tab 32 of the movable blade 16.

The sliding piece 12 is designed so it can slide in the directions of arrows 21 and 22. In order to facilitate replacement of the cutting and gripping elements, groove 31 may be designed to be opened, for example by having the sliding piece 12 designed so it is in two parts in the area of groove 31, so the top part can be removed and thus the entire cutting and gripping element 1 is removed by pulling it upward in the direction of arrow 21 from pin 40.

Figure 2A:
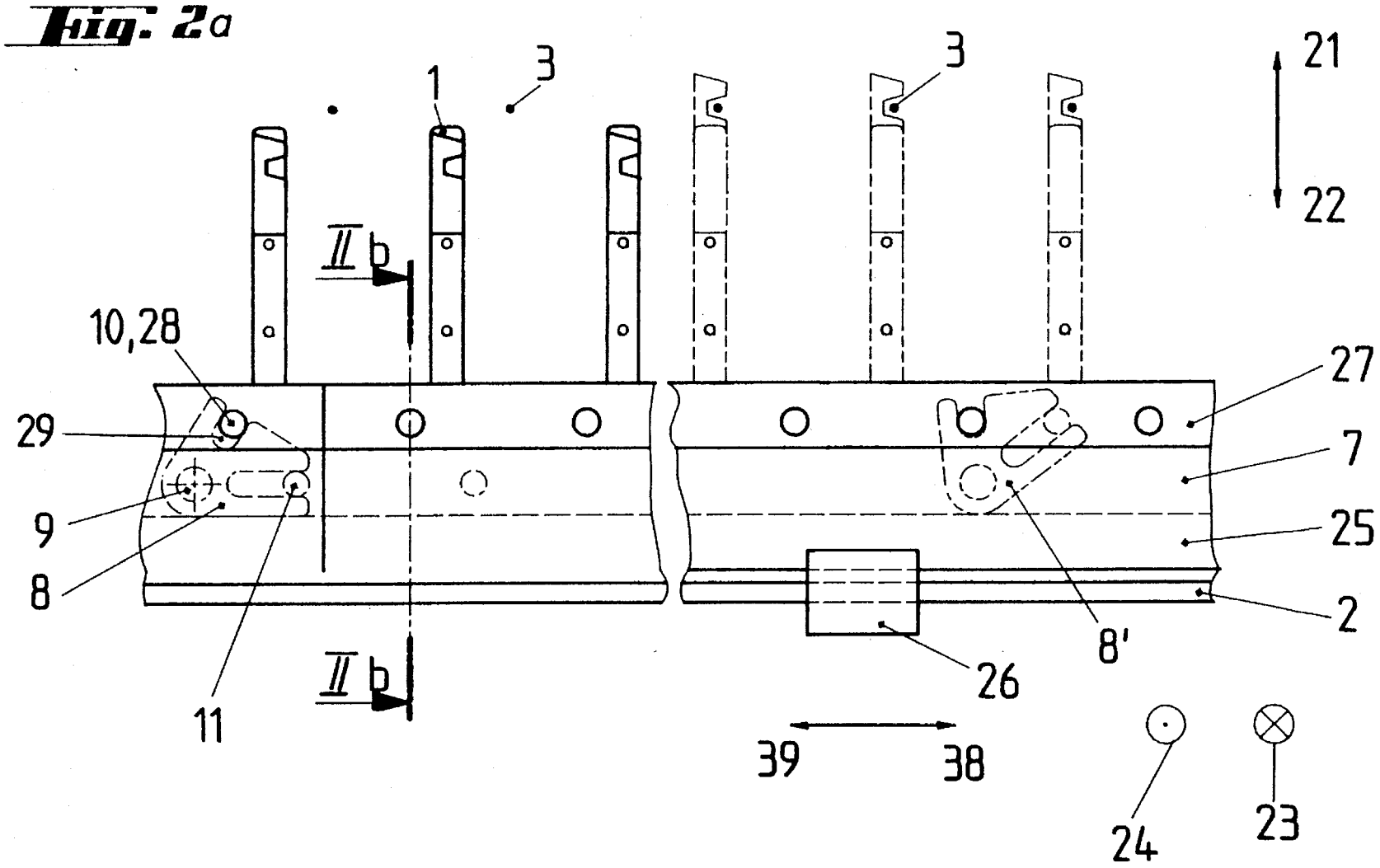
FIGS. 2*a* and 2*b* are respectively a front view of a section of a feeder bar of the invention in the two positions, "forward" and "rearward,", and a cross section through the feeder bar.
Figure 2B:
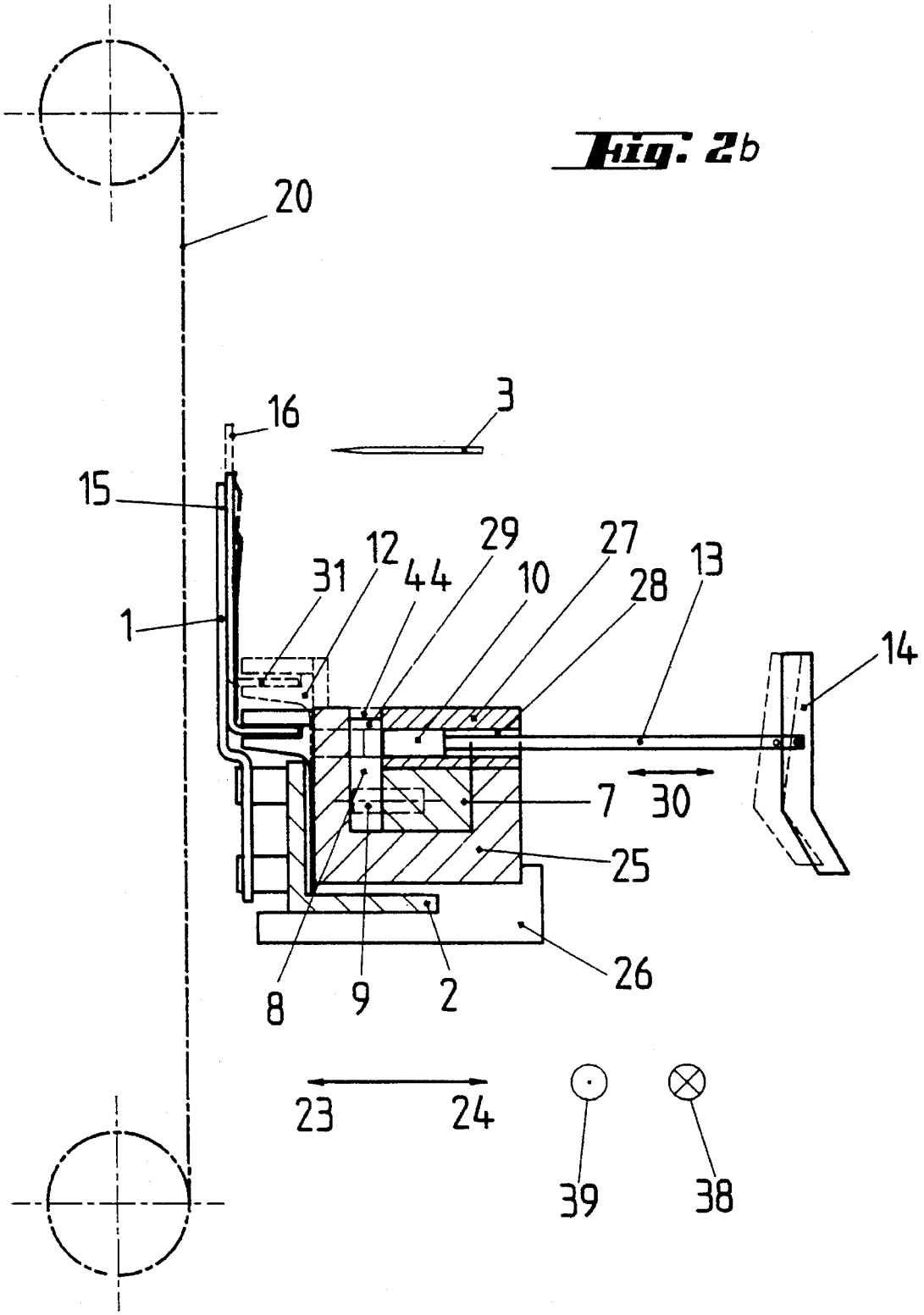

Sliding piece 12 is attached with a pin 11 and it is mounted so it can slide in a stationary guide rail 25 in a vertically aligned recess (FIG. 2*b*). Because of the guidance of the cut in FIG. 2*b*, this vertical recess in which sliding piece 12 is mounted so it can slide cannot be discerned.

The guide rail 25 consists essentially of a U-shaped section that holds the driving rod 7 in its interior at right angles to the plane of the drawing in FIG. 2*b*.

According to FIGS. 1*a* and 2*a*, a row of pivot points 9 are arranged at intervals. These pivot points are designed in the form of pins and each holds an angle lever 8 so it can pivot.

The angle lever 8 consists of two swivel arms, each of which has an elongated hole 29, 43. One elongated hole 29 is for engaging a retention pin 10 in a sliding engagement, whereby said pin can move in the direction of the arrow 23 and in the opposite direction in FIG. 2*b*. For this purpose, the retention pin 10 sits in a borehole 28 in a cover 27, where said cover 27 is part of the guide rail 25 and is connected securely to the latter.

A slide 13 that is connected to a switch lever 14 of the embroidery position switch engages in borehole 28.

Feeder bar 2 executes the above-mentioned parallelogram movement that is illustrated in the form of a diagram in FIG. 1*c*. In this regard, it is important for the swivel lever 6 to be connected to the guide rail at pivot point 5, where the free pivoting ends of the lever are connected to the feeder bar 2.

Thus, the feeder bar 2 executes a parallelogram-like movement due to the pivoting movement of the swivel levers 6 and thus assumes the "forward" position near the fabric in the direction of arrow 38 in FIG. 1*c* as well as a "rear" position that is raised up from the fabric and is a distance away from the embroidery needle in the direction of arrow 39.

Due to the fact that the cutting and gripping elements 1 are securely attached to the feeder bar by means of pins 40, the cutting and gripping elements therefore execute the above-mentioned parallelogram-like movement.

Feeder bar 2 is guided locally on stationary mounts 26 which are attached to guide rail 25. Accordingly, feeder bar 2 can move in the direction of arrows 23 and 24 as well as at right angles to the latter in the direction of arrows 38 and 39, which leads to the above-mentioned superimposed parallelogram-like movement of the feeder bar 2 and thus all the cutting and gripping elements 1.

The mounts 26 that are held with some distance between them on the bottom side of the guide rail 25 (FIG. 2*a*) thus serve the function of providing additional guidance for the feeder bar. Therefore, guidance of the cutting and gripping elements without any play is achieved in the direction of the plane 20 of the fabric and also in the direction normal to the latter.

FIG. 2*b* shows the position of the cutting and gripping elements where they are raised up from the plane 20 of the fabric.

The embroidery needles 3 are also mounted in such a way that they can be replaced in needle mounts 41, where said needle mounts 41 are held in a guide and are guided so they move at right angles to the plane 20 of the fabric.

If it is necessary to cut the threads, the feeder bar 2 is advanced into the "forward" position and then is positioned so close to the plane of the fabric that the last stitch taken by the needle is taken in the side recess 19 in the movable blade 16.

FIGS. 2*b* and 3*b* show the cutting and gripping operation. The movable blade 16 is moved upward so the needle axis (puncture sites or stitching points) comes to lie in the side recess 19. This opening of the blade can take place before the feeder bar 2, together with cutting and gripping elements 1, is advanced into the forward operating position. The opening of all the blades—in other words, the movement of the movable blades 16 upward, is triggered by the drive rod 7. With a horizontal movement of the drive rod toward the right, the angle lever 8 is prevented by retention pin 10 from following the movement of the drive rod in a constant position. Since the one lever arm is held back by retention pin 10, the angle lever 8 rotates about the pivot point 9 and thus pushes pin 11 up with its second arm. Pin 11 is securely connected to sliding piece 12. The movable blade 16 is moved upward by the sliding piece with a groove 31. After the last needle stitch, the movable blade 16 is pulled down by a horizontal movement of the drive rod 7 while the front thread is under tension. Due to this movement, the front thread is pulled under the friction spring 18 and then cut by the cutting edges of the movable blade 16 and the stationary blade 15. The parallel guide 17 assures that the movable blade 16 moves exactly in parallel with the stationary blade 15 and thus guarantees a clean thread cut between the cutting edges.

A cut thread will remain in the grip between friction spring 18 and the movable blade 16 until the next stitch. The feeder bar 2 with the cutting and gripping elements 1 is moved back into the "rear" resting position.

In making another stitch, the feeder bar 2 together with all the cutting and gripping elements 1 goes into the "forward" position where the cutting and gripping elements are in direct contact with the fabric. After starting the first stitch, the movable blade 16 is raised up and thus releases the thread end that is secured under the friction spring 18. The cutting and gripping elements 1 return to their "rear" resting position. Due to the fact that the cutting and gripping elements 19 are in direct contact with the fabric during both cutting and stitching, the remaining thread end is so short that there is no need for a subsequent operation (cutting off the thread ends).

With a so-called embroidery position switch, individual embroidery positions can be connected to the drive or disconnected from it, so a certain combination of stitching and non-stitching positions is defined. In non-stitching positions, the thread cutter should not be in operation. This is accomplished by retracting the retention pin 10. With a movement of the drive rod 7 to the right or left, the one lever arm of angle lever 8 is thus no longer locked. Therefore, it no longer rotates about pivot point 9 and the movable blade 16. is not driven by pin 11—in other words, the cutting and gripping operation does not take place at this stitching position.

The positioning or retraction of retention pin 10 can be accomplished with the stitching position switch or its switch lever 14 by way of connection 13. However, separate devices (magnets, etc.) may also be provided for this purpose.

The preceding discussion thus concerns a selection process to show how the stitching position switch of the retention pin 10 is positioned or not by operating the switch lever 14. Positioning the retention pin means that it is shifted to the left in its borehole 28 in the direction of arrow 30 (FIG. 2*b*) so it engages in the respective elongated hole 29 of the angle lever 8 and thus engages the angle lever 8 with the driven feeder bar. As mentioned above, the angle lever 8 is mounted in a recess 44 in the area of guide rail 25 so it can pivot about pivot point 9.

When the retention pin 10 engages in the elongated hole 29 of the angle lever 8, the latter secures a pivot arm with its elongated. hole 29 on the stationary guide rail 25 and thus forms a stationary pivot point about which the angle lever 8 pivots when the feeder bar 2 is shifted in the direction of arrows 38 and 39.

As already mentioned above, pin 11 is securely attached to sliding piece 12 and this pin engages in the elongated hole 43 in the opposing lever end of angle lever 8.

FIG. 2*a* shows the two different pivot positions of angle lever 8, where it can be seen that when the drive rod 7 is shifted in the direction of arrow 38, the angle lever is pivoted about the stationary retention pin 10 and at the same time pin 11 is moved upward (direction of arrow 21 ), so the sliding piece 12 is raised and it in turn moves the movable blade 16 upward in the direction of arrow 21.

Thus, three functions are differentiated in the arrangement according to this invention, namely:

1. A selector mechanism for the functioning and non-functioning embroidery positions, where said selector mechanism is operated by means of switch lever 14 and slide 13 which operates the retention pin 10.
2. An opening movement of the blade, whereby the sliding piece 12 is moved in the direction of arrow 21 as described above in this movement and the movable blade 16 is moved into the position according to FIGS. 3*a* and 3*b*.
3. A parallelogram-like shift of all cutting and gripping elements which are arranged on a joint feeder bar 2 with a superimposed pivoting movement in the direction of arrows 23 and 24 or 38 and 39 in the direction of the plane 20 of the fabric and in the opposite direction.

The drive rod 7 is driven by an electromagnetic, pneumatic or hydraulic drive so it can move in the direction of movement 38, 39. This drive is not shown in detail in the figures but is common knowledge for those skilled in the art.

In the present description, a joint operation of all the cutting and gripping elements by a joint drive rod 7 is described. It is within the scope of this invention and it is also deemed essential to the invention that instead of the drive rod 7 described here, an individual drive is provided for each individual cutting and gripping element, whereby the drive rod 7 is replaced by corresponding operating elements which have their actuating elements in direct contact with the sliding pieces 12 which they move in the direction of arrows 21 and 22.

In the preceding description, it has been assumed that the cutting and gripping elements 1 execute a movement in the form of a parallelogram, moving toward and away from the plane 20 of the fabric, which has the advantage that in the resting position the cutting and gripping elements 1 are a distance away from the plane of the fabric.

In another simpler embodiment, instead of the forward and retracting movements of the cutting and gripping elements with respect to the plane of the fabric, the cutting and gripping elements remain close to the plane 20 of the fabric at all times and there is no longer any lifting movement. This is a simpler mechanical design and solves the problem posed according to this invention.

In one embodiment, the drive rod 7 is guided longitudinally in a recess in the U-shaped guide rod.

In an alternative embodiment, the drive rod 7 is guided so it can move lengthwise on the feeder bar 2, which thus eliminates the need for the guidance in guide rail 25.

Figure 4:
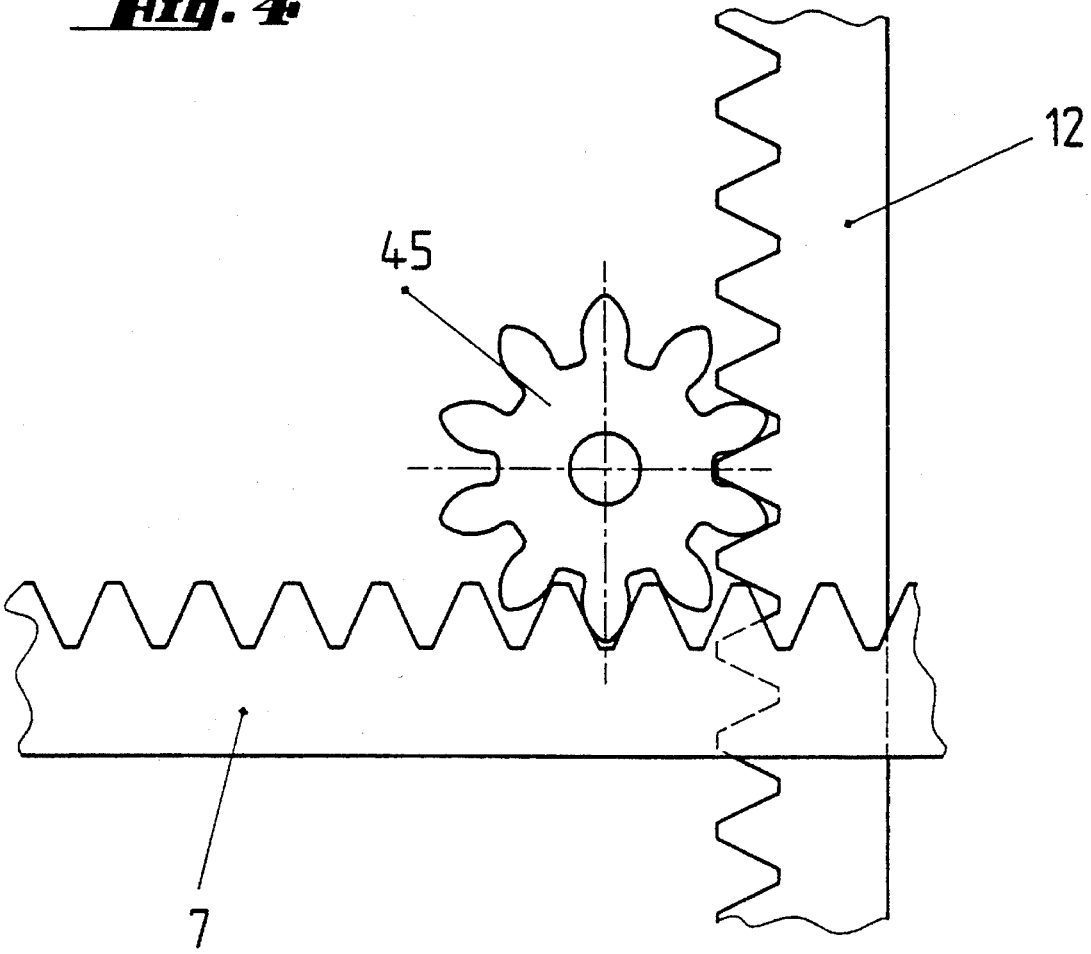
FIG. 4 is a schematic diagram of the drive of the movable blade with a gear wheel drive of the invention.

With reference to FIG. 4, it is there shown that the horizontal longitudinal movement of the drive rod 7 is transmitted by gear teeth on the drive rod 7 to the movable blade 16, whereby a gearwheel 45 in a fixed mount engages in the teeth on sliding piece 12 and thus converts the sliding movement of the drive rod into a vertical gripping and cutting movement.

What is claimed is:

1. An apparatus for cutting and gripping a front yarn of an embroidery machine of the type having a large number of embroidery needles arranged in one or more rows, comprising:

a feeder bar supported by and movable with respect to said embroidery machine;

a joint, mechanically-connected drive mechanism;

a large number of actuatable cutting and gripping elements for cutting and gripping said front yarn actuated by said drive mechanism and positioned on said feeder bar in a manner that corresponds to the arrangement of the embroidery needles on said embroidery machine;

and a selector mechanism connecting only certain of said cutting and gripping elements to said drive mechanism.

2. The apparatus recited in claim 1, and further comprising a plurality of individual actuating devices actuated by said drive mechanism, each provided for a separate one of said cutting and gripping elements.

3. The apparatus recited in claim 2, and further comprising a selector connected to said plurality of actuating devices, wherein only certain actuating devices are selected by means of said selector.

4. The apparatus recited in claim 2, wherein each of said large number of cutting and gripping elements comprise an individual, complete element, and each of said cutting and gripping elements are positioned on the feeder bar in such a way that they are easily individually replaced.

5. The apparatus recited in claim 2, wherein said joint drive mechanism comprises:

a two-armed angle lever that is rotatably mounted on the drive rod, with one arm of the angle lever secured to the feeder bar by a retention pin and the other arm of the angle lever secured to one of said cutting elements by a separate retention pin, whereby the angle lever executes a rotational movement due to the horizontal movement of the drive rod and creates vertical movement of the cutting elements.

6. The apparatus recited in claim 5, wherein one of the said retention pins that secures the lever arms of the angle lever is movable in its axis in such a way that the angle lever is no longer secured, and therefore there is no rotational movement of the angle lever, so the vertical movement of the corresponding cutting element is also suppressed.

7. The apparatus recited in claim 6, wherein the axial movement of the retention pin is detected by a stitch position switch.

8. The apparatus recited in claim 1, wherein said feeder bar is divided over the entire length of the embroidery machine into separate modules/sections.

9. The apparatus recited in claim 1, wherein said cutting and gripping elements are constantly in close contact with a plane of the embroidery fabric and said feeder bar pivots with respect to said embroidery machine in such a way that said cutting and gripping elements move parallel to said plane of the fabric into the area of the needle stitching points and then out of this area.

10. The apparatus recited in claim 1, and further comprising a stationary guide rail having a recess formed therein, said guide rail being attached in a parallel manner to said feeder bar, wherein the joint drive mechanism of said cutting and gripping elements consists of a drive rod that is guided to move longitudinally in said stationary guide rail recess.

11. The apparatus recited in claim 1, wherein the joint drive mechanism of said cutting and gripping elements consists of a drive rod and wherein said drive rod is guided on said feeder bar.

12. The apparatus recited in claim 1, wherein the joint drive mechanism of said cutting and gripping elements consists of a drive rod and wherein said drive rod is divided into sections, each having their own drive mechanism.

13. The apparatus recited in claim 1, wherein the joint drive mechanism of said cutting and gripping elements consists of a drive rod and wherein each of said cutting and gripping elements comprise:

a stationary blade mounted on the feeder bar; and a movable blade attached to a slidable piece that is slidably mounted on the feeder bar, said movable blade is driven by the drive rod and executes a vertical cutting and gripping movement in the longitudinal axis of the two blades.

14. The apparatus recited in claim 13, wherein the movable blade is guided in parallel to the stationary blade.

15. The apparatus recited in claim 1, wherein each of said cutting and gripping elements comprise:

a stationary blade mounted on the feeder bar;

a movable blade attached to a slidable piece that is slidably mounted on the feeder bar; and a friction spring mounted on the stationary blade and receiving said movable blade in a manner that biases said movable blade against said stationary blade, said friction spring and said movable blade forming a gripping area on a surface of said movable blade, wherein, upon positioning said cutting and gripping element adjacent the stitching point, movement of the blade in the cutting operation results in the embroidery thread being pulled into the gripping area by the blade movement.

16. The apparatus recited in claim 15, wherein said movable blade has a side recess formed therein, whereby each of the cutting and gripping elements are brought from the side into the area of the needle stitch in such a way that the needle thread coming out of the stitch comes to lie in the area of the cutting and gripping elements.

* * * * *